US005281778A

United States Patent [19]

Cheladyn et al.

[11] Patent Number: 5,281,778

[45] Date of Patent: Jan. 25, 1994

[54] VEHICULAR MUFFLER WITH HEAT SHIELD

[75] Inventors: Joseph M. Cheladyn, Wheaton; Steven P. DeMik, Worth, both of Ill.

[73] Assignee: Midas International Corporation, Chicago, Ill.

[21] Appl. No.: 82,486

[22] Filed: Jun. 28, 1993

[51] Int. Cl.[5] ..... F01N 7/18

[52] U.S. Cl. ..... 181/241; 181/211

[58] Field of Search ..... 181/211, 241, 243, 282; 180/89.2, 309; 60/299, 320, 321

[56] References Cited

U.S. PATENT DOCUMENTS

| | | | |
|---|---|---|---|
| 1,360,311 | 11/1920 | Padgett | 181/243 |
| 1,853,549 | 9/1929 | Clark | 228/144 |
| 2,474,138 | 8/1945 | Zimmerman | 228/144 |
| 2,802,596 | 6/1955 | Weil | 228/154 |
| 2,834,427 | 5/1958 | Powers et al. | 181/243 |
| 2,946,395 | 9/1958 | Overland | 181/243 |
| 2,966,226 | 11/1959 | Kalis | 181/243 |
| 3,237,716 | 3/1966 | Parsons | 180/89.2 |
| 3,276,108 | 10/1966 | White | 29/890.08 |
| 4,085,816 | 4/1978 | Amagai | 180/89.2 |
| 4,378,046 | 3/1983 | Klinger | 60/321 X |
| 4,478,310 | 10/1984 | Harter | 181/241 |
| 4,609,067 | 9/1986 | Gonwa | 181/211 |
| 5,036,947 | 8/1991 | Metzger | 181/241 |

*Primary Examiner*—Michael L. Gellner
*Assistant Examiner*—Khanh Dang
*Attorney, Agent, or Firm*—Anthony S. Zummer

[57] ABSTRACT

The vehicular muffler assembly of this invention includes a muffler which has a elongated shell. An inlet communicates with the interior of the shell to provide a port for entry of exhaust gases from an internal combustion engine to the interior of the shell. An outlet communicates with the interior of the shell to allow exhaust gases to leave the shell. A heat shield is mounted on the exterior of the shell. The heat shield is symmetrical and has an outer wall. The outer wall has a weld skirt which is integral with the outer wall. A plurality of discreet welds spaced along the weld skirt fixes the outer wall to the shell. A slot opening is formed in the weld skirt between adjacent discreet welds.

14 Claims, 2 Drawing Sheets

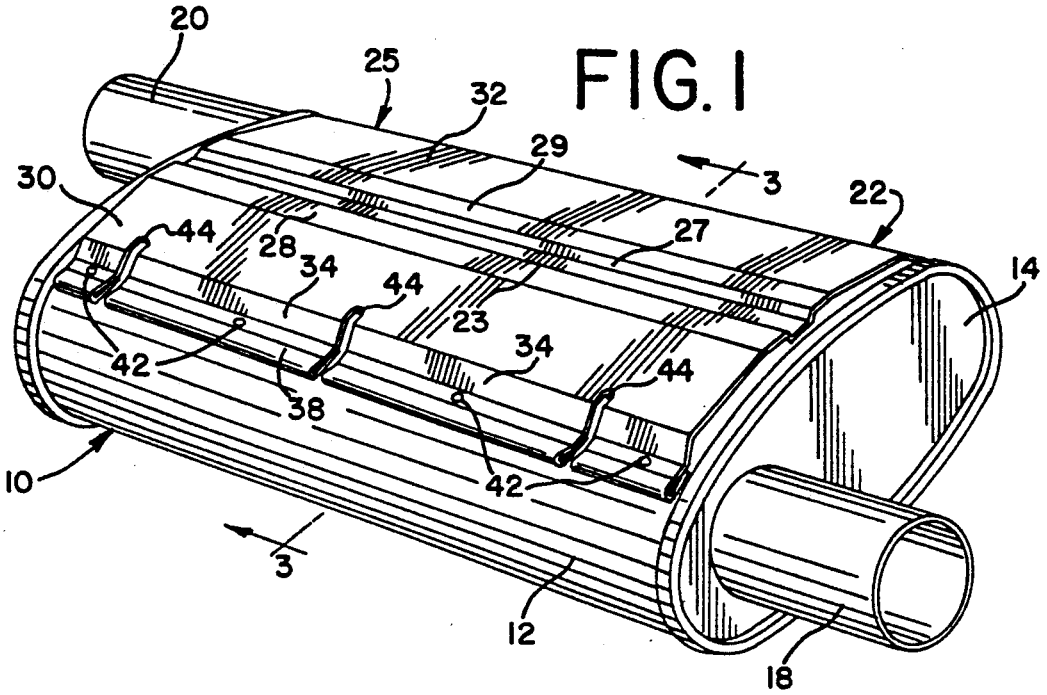
FIG. 1
FIG. 2
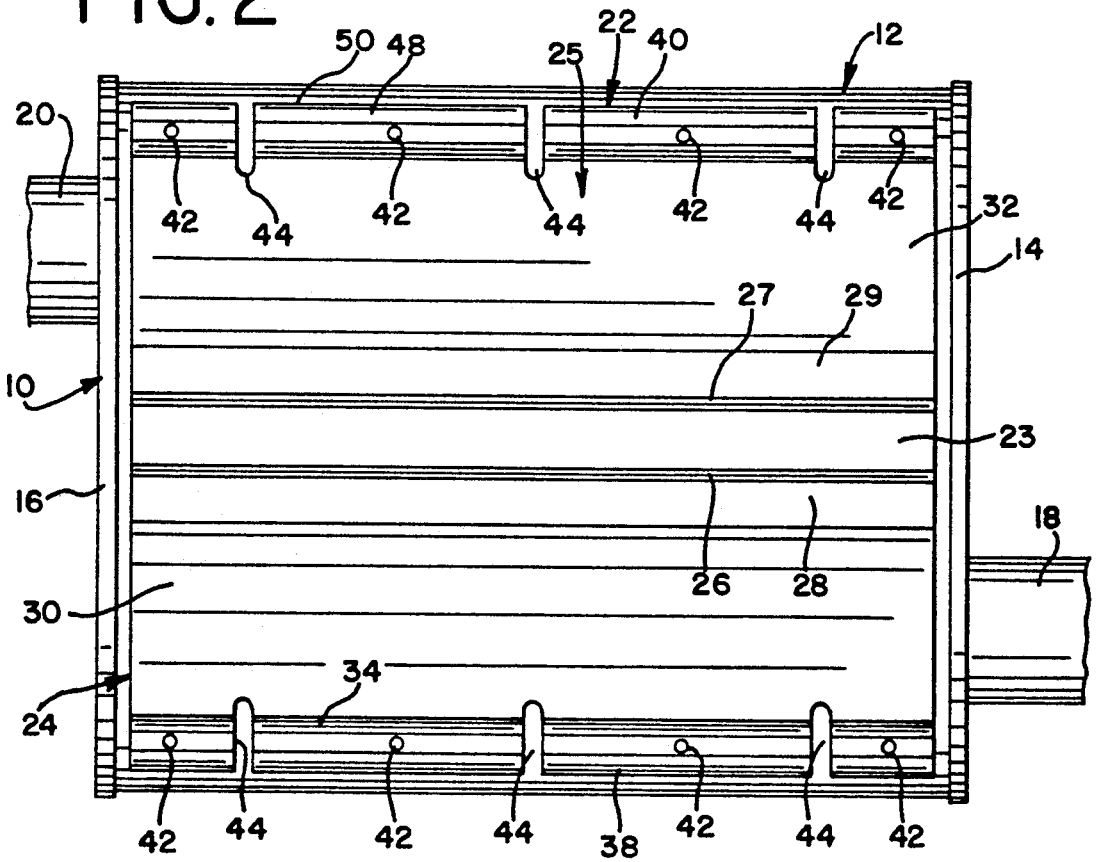

FIG. 3
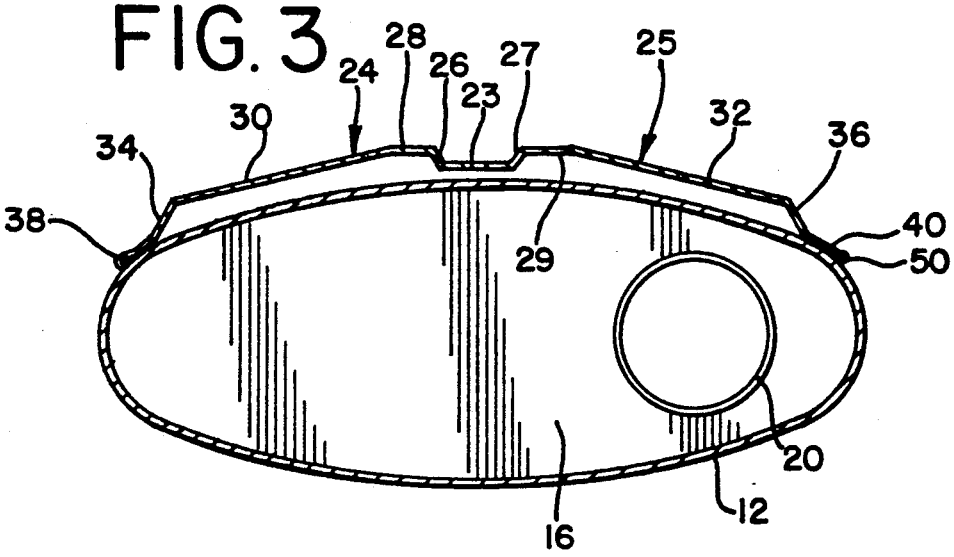
FIG. 4
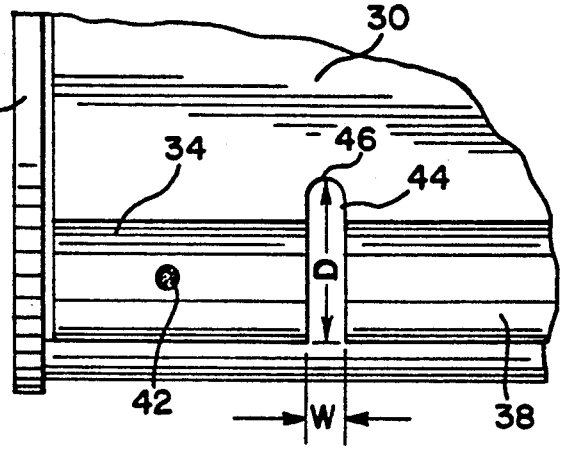
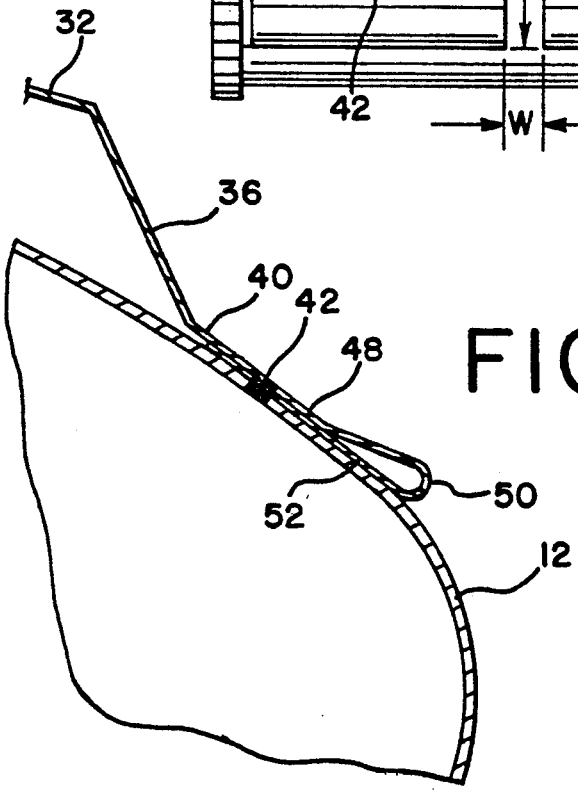
FIG. 5

VEHICULAR MUFFLER WITH HEAT SHIELD

BACKGROUND OF THE INVENTION

The ordinary construction for a vehicle having an internal combustion engine includes an exhaust system for handling exhaust gases. Typically, the exhaust system includes an exhaust pipe for directing exhaust gases from the internal combustion engine to a muffler, the gases then flow to a tail pipe and into the surrounding atmosphere. There may be additional pieces of equipment in series with the muffler, such as, a catalytic converter and a resonator. The desire of some vehicle designers to make vehicles low has resulted in some instances of having the muffler positioned immediately adjacent to the underside of a passenger compartment. The proximate positioning of the muffler to the passenger compartment has led to a recognition of the desirability of positioning a heat shield between the muffler and the passenger compartment.

The use of heat shields on vehicular mufflers is taught in U.S. Pat. No. 4,478,310, issued to Donald P. Harter on Oct. 23, 1984, entitled "Universal Heat Shield"; and U.S. Pat. No. 4,609,067, issued to Charles J. Gonwa on Sep. 2, 1986, entitled, "Heat Shield For A Vehicular Muffler". Both the Harter and Gonwa disclosures teach heat shields which are secured to a muffler by straps. Gonwa suggests that it is well known to weld a heat shield to a muffler body.

A typical method of welding a heat shield to a muffler shell is to make a series of discreet spot welds along the edge of each side of the heat shield to secure the heat shield to the shell. The utilization of spot welding is desirable inasmuch as it is a quick and efficient method of permanently securing the heat shield to the shell. However, prolonged use of the muffler often results in a problem in that some of the spot welds break, resulting in the heat shield having at least one edge freed from the shell to create an objectionable rattle.

The utilization of straps eliminates the breaking apart of spot welds; however, the added cost of providing the straps and applying the straps with the heat shield to the muffler shell increases the overall cost of the muffler assembly. It is therefore desirable to solve the problem of breaking spot welds s that it is not necessary to utilize straps.

SUMMARY OF THE INVENTION

The instant invention provides an improved vehicular muffler assembly wherein a heat shield is spot welded to a shell, but the spot welds do not break apart readily in the course of usage.

The cause of breakage of spot welds during usage of the vehicular muffler revolves around the differences in expansion between the heat shield and the shell. The heat shield is aligned with the shell of the muffler. Two parallel outermost edges of the heat shield are spot welded to the shell. The heat shield and the shell are aligned with the spot welds in two generally parallel lines parallel to the length of the shell. The shell, which receives the exhaust gases, is heated a greater amount than the heat shield causing the shell to expand a greater amount than the heat shield. When the shell expands a greater amount than the head shield, a shear force is created at each of the spot welds. The repeated heating and cooling of the muffler causes the metal at the spot welds to fatigue and break, so that at least one edge of the heat shield often comes apart from the shell.

The present invention provides an elongated slot in the heat shield edge between the discreet welds which secure the heat shield to the shell. The slots allow the shell to expand and carry along with it a portion of the heat shield so that the magnitude of shear stress which is applied to each of the spot welds is substantially reduced. Thus, there is a reduction in the fatigue in the metal at each of the spot welds thereby increasing the life of the spot welds so the heat shield is not allowed to loosen from the shell.

BRIEF DESCRIPTION OF THE DRAWINGS

FIG. 1 is a perspective view of a vehicular muffler assembly having a heat shield secured to a shell by discreet spot welds with slots in the heat shield between discreet spot welds;

FIG. 2 is a plan view of the muffler assembly of FIG. 1;

FIG. 3 is an enlarged cross-sectional view taken on Line 3—3 of FIG. 1 showing the cross-sectional arrangement of the heat shield and the relative position of the heat shield on the shell;

FIG. 4 is an enlarged fragmentary portion of FIG. 2 showing a spot weld and a slot adjacent to the spot weld; and FIG. 5 is an enlarged fragmentary portion of FIG. 3 showing in greater detail a weld skirt of the heat shield and a spot weld fixing the heat shield to the muffler shell.

DETAILED DESCRIPTION OF THE INVENTION

Referring to the drawings and in particular to FIG. 1, a vehicular muffler having a heat shield is shown therein and is generally identified by numeral 10. Muffler 10 is a specific embodiment of the present invention. Muffler 10 generally includes a conventional elongated shield 12 which has a generally elliptical cross section. An inlet end cap 14 closes one end of the shell, and an outlet end cap 16 closes the other end of the shell. An inlet 18 is sealingly secured to end cap 14 to allow exhaust gases from an internal combustion engine to enter the interior of shell 12. An outlet 20 is sealingly fixed to end cap 16 to allow the gases to exhaust from the interior of the shell. The interior muffler construction of shell 12 is conventional and well known in the art and is not shown herein. The shell, end caps, inlet and outlet are all made of a suitable metal, such as, an aluminized sheet steel.

A heat shield 22, also made of aluminized sheet steel, is fixed to a portion of the exterior of shell 12 and extends substantially the entire length of one side of the shell. The length of the heat shield is parallel to the length of the shell. As may be seen in FIG. 2, the heat shield does not extend entirely between caps 14 and 16, but rather has a small space between each end of the heat shield and the respective cap. The sheet metal heat shield is, in this instance, bent to a desired shape symmetrical about its longitudinal center. As may be best seen in FIG. 3, heat shield 22 has at its center a gully 23. A pair of opposed outer walls 24 and 2 is formed integral with opposite sides of the gully. Outer walls 24 and 25 include scarp walls 26 and 27, respectively, which scarp walls are formed integral with respective opposed edges of the gully. Inner slope walls 28 and 29 are formed integral with scarp walls 26 and 27, respectively. Terrepleins 30 and 32 are an integral part of outer walls 24 and 25, respectively, and are formed integral with inner slope walls 28 and 29, respectively. The terrepleins extend outward from the gully. Outward slope walls 34 and 36 are formed integral with terrepleins 30 and 32, respectively, and are an integral part of outer walls 24 and 25, respectively. Weld skirts 38 and 40 are formed integral with the outer slope walls of the outer walls 24 and 25, respectively. As may be seen in FIGS. 2 and 3, the heat shield is symmetrical about gully 23 along its length.

Looking now to FIG. 2, in this instance, four identical conventional discreet spot welds 42 on each of the weld skirts 38 and 40 fix opposite edges of heat shield 22 to shell 12. Gaps are provided in the weld skirts and outer walls between the spot welds. In the present embodiment, each gap is an elongated slot 44 positioned between each pair of adjacent spot welds, as may be seen in FIGS. 1 and 2. Slots 44 are identical to each other and extend through the respective weld skirt, the respective outer slope wall and into the respective terreplein of the respective outer wall.

Each slot 44 has a width (W) and a length or depth (D) which depth (D) is more than three times greater than the width (W). In the present specific embodiment, the length or depth (D) is approximately one inch and the width (W) is approximately one-fourth of an inch. It may be appreciated that other specific dimensions may be used. The length of each slot is perpendicular to the outer edge of the weld skirt and the width is parallel to the respective outer edge. Each slot has a rounded bottom 46 which reduces any stress concentration at the end of each slot.

The detailed construction of each of the weld skirts 38 and 40 is identical except that they are mirror images of each other when viewed in FIG. 3. The specific construction of weld skirt 40 is shown in detail in cross-section in FIG. 5. Weld skirt 40 includes an exterior flat edge 48 which is integral with outward slope wall 36. Exterior flat edge 48 extends outward into a fold 50. An interior flat edge 52 is formed integral with fold 50 and underlies exterior flat edge 48. Fold 50 defines a longitudinal edge of the heat shield which longitudinal edge extends parallel to the gully and the length of shell 12. The longitudinal edge is interrupted by slots 44.

The heat shield, in its manufacture, is bent to its desired shape, as is shown in FIG. 3, with the interior flat edge folded into engagement with the exterior flat edge. Slots 44 are cut into the weld skirts and outer walls. The heat shield is positioned on the exterior of the shell and, in this instance, four discreet spot welds are made on each of the weld skirts. Each spot weld welds the interior flat edge to its respective exterior flat edge and welds the interior flat edge to shell 12. The spot welds are positioned on the weld sheets so that a slot 44 separates adjacent spot welds. Fold 50 provides a longitudinal edge which is a rounded edge and reduces the likelihood of materials catching on the edge. The heat shield does not have a longitudinal raw edge exposed, which may be sharp and cause injury to workmen handling the muffler from its sides during installation.

When the muffler is in use in a vehicle, the exhaust gases from an internal combustion engine enter the inlet and are exhausted through the outlet. The interior of the muffler becomes heated. The shell is heated by the exhaust gases causing the shell to expand. The heat shield is secured to the shell at the weld skirts, but the major portion of the heat shield is spaced away from the shell. Thus, the heat shield, as is desired, has a lower temperature than the shell. The shell expands due to its increase in temperature. If the heat shield and the shell have the same or similar coefficients of linear expansion, it is clear that the shell expands a greater distance than the heat shield. The heat shield tends to resist expansion of the shell. The shell creates a force to pull away from the heat shield. This creates a shear force between the heat shield and the shell at the spot welds. The resisting force of the heat shield is greatly minimized by the slots 44 between adjacent spot welds. As the heat shield is expanded and it applies a force to the heat shield, the resistance by the heat shield to movement is minimized because the heat shield can bend at the slots to accommodate the movement of the shell. This ability to accommodate the movement of the shell reduces the amount of shear force between the heat shield and the shell, thereby reducing the force applied to the spot welds. The reduction in applied force reduces the shear stress across the spot welds so that breakage of the spot welds between the shell and the heat shield is substantially reduced. The heat shield then does not become loosened from the shell but rather is permanently secured to the shell with the heat shield remaining secured to the shell irrespective of the number of cycles of heating and cooling that the muffler experiences.

Although a specific embodiment of the herein disclosed invention has been described in detail, it is readily apparent that those skilled in the art may make various modifications and changes without departing from the spirit and scope of the present invention. It is to be expressly understood that the scope of this invention is limited only by the appended claims.

We claim:

1. In a vehicular muffler assembly including; a muffler having an elongated shell having a length extending in one direction, an inlet communicating with an interior of the shell, an outlet communicating with the interior of the shell, and a heat shield mounted on a portion of an exterior of the shell, the heat shield having an outer wall, said outer wall having a weld skirt formed integral therewith, said weld skirt being substantially parallel to the elongated shell, a plurality of discreet welds spaced along the weld skirt securing the weld skirt to the exterior of the shell, and a gap in the weld skirt between adjacent welds.

2. In a vehicular muffler assembly as defined in claim 1, wherein the weld skirt includes a longitudinal edge parallel to the length of the elongated shell, the gap is a slot being elongated and substantially perpendicular to the longitudinal edge.

3. In a vehicular muffler assembly as defined in claim 1, wherein the gap has a width along the weld skirt less than the length of the gap substantially perpendicular to the width.

4. In a vehicular muffler assembly as defined in claim 1, wherein the weld skirt includes a longitudinal edge substantially parallel to the length of the elongated shell, each gap in the weld skirt is a slot having a length perpendicular to the longitudinal edge, each slot having a width substantially parallel to the longitudinal edge, and the width being less than one-third the length of the respective slot.

5. In a vehicular muffler assembly as defined in claim 1, wherein each gap in the weld skirt has at a terminus a rounded end portion.

6. In a vehicular muffler assembly as defined in claim 1, wherein the weld skirt has an elongated portion folded on itself.

7. In a vehicular muffler as defined in claim 1, wherein the weld skirt has an elongated portion folded adjacent to the shell and in engagement with the shell.

8. In a vehicular muffler as defined in claim 1, wherein the weld skirt has an elongated portion folded on itself forming a longitudinal edge substantially parallel to the length of the shell, said gap being a slot extending through the folded elongated portion, the slot having a length perpendicular to the longitudinal edge, the slot having a width substantially parallel to the longitudinal edge, the length of each slot being greater than the width of the respective slot.

9. In a vehicular muffler assembly as defined in claim 1, wherein the weld skirt has an elongated portion folded and in engagement with the elongated shell, each of said discreet welds fixes a respective portion of the folded elongated portion to another portion of the weld skirt and to the elongated shell, the gap being a slot in the weld skirt extending through the folded portion, the slot having a length substantially perpendicular to the length of the elongated shell and a width substantially parallel to said length, and the slot having its length at least three times greater than its width.

10. In a vehicular muffler assembly including: a muffler having an elongated shell, said shell having a length extending in one direction, an inlet communicating with an interior of shell, an outlet communicating with the interior of the shell, and a heat shield mounted on a portion of an exterior of the shell, the heat shield having an outer wall, said outer wall having a folded portion folded parallel to a portion of the outer wall defining a longitudinal edge substantially parallel to the length of the shell, and the folded portion is positioned under the outer wall and in engagement with the elongated shell.

11. In a vehicular muffler as defined in claim 10, wherein the folded portion is spot welded to the outer wall and to the shell to fix the folded portion and wall to the shell.

12. In a vehicular muffler assembly including; a muffler having an elongated shell, said shell having a length extending in one direction, an inlet communicating with an interior of the shell, a outlet communicating with the interior of shell, and a heat shield mounted on a portion of an exterior of the shell, the heat shield having an elongated gully substantially parallel to the length of the shell, a pair of opposed outer walls formed integral with the gully, each of said outer walls having a weld skirt formed integral with an outer edge, said weld skirts extending in opposite directions, a plurality of discreet welds spaced along each weld skirt securing the respective weld skirt to the exterior of the shell, and a gap between adjacent welds on each weld skirt.

13. In a vehicular muffler as defined in claim 12, wherein each gap is a slot substantially perpendicular to the gully.

14. In a vehicular muffler as defined in claim 13, wherein a length of each of the slots perpendicular to the gully is greater than a width of the respective slot.

* * * * *

UNITED STATES PATENT AND TRADEMARK OFFICE

CERTIFICATE OF CORRECTION

PATENT NO. : 5,281,778

DATED : January 25, 1994

INVENTOR(S) : Joseph M. Cheladyn and Steven P. DeMik

It is certified that error appears in the above-identified patent and that said Letters Patent is hereby corrected as shown below:

Column 1, Line 47, after "welds" delete "s" substitute therefor --so--

Column 2, Line 62, delete "2" substitute therefor --25--

Column 5, Line 24 after "including" delete ":" substitute therefor --;--

Signed and Sealed this

Fourteenth Day of June, 1994

Bruce Lehman

*Attest:*

BRUCE LEHMAN

*Attesting Officer*

*Commissioner of Patents and Trademarks*